United States Patent [19]

Traumüller et al.

[11] Patent Number: 4,550,832

[45] Date of Patent: Nov. 5, 1985

[54] STACKABLE BOX WITH ADJUSTABLE COVER

[75] Inventors: Otfried Traumüller; Gerd Weinberg, both of Oberstenfeld, Fed. Rep. of Germany

[73] Assignees: Furnier -u. Sperrholzwerk; J. F. Werz Jr. KG Werzalit-Pressholzwerk, both of Oberstenfeld, Fed. Rep. of Germany

[21] Appl. No.: 145,057

[22] Filed: Apr. 30, 1980

[30] Foreign Application Priority Data

May 19, 1979 [DE] Fed. Rep. of Germany ..... 2920431

[51] Int. Cl.[4] ..... B65D 6/24; B65D 21/02

[52] U.S. Cl. ..... 206/509; 217/12 R; 220/4 F; 229/43

[58] Field of Search ..... 220/4 F, 305; 229/43; 206/509; 217/12 R

[56] References Cited

U.S. PATENT DOCUMENTS

| | | | |
|---|---|---|---|
| 1,608,046 | 11/1926 | Stanley | 220/4 F |
| 1,657,084 | 1/1928 | Hothersall | 220/4 F |
| 1,672,453 | 6/1928 | Gibbs | 217/12 R |
| 3,351,265 | 11/1967 | Miller | 229/43 |
| 3,749,276 | 7/1973 | Davis | 229/43 |
| 4,167,232 | 9/1979 | Munk | 220/4 F |

*Primary Examiner*—George E. Lowrance
*Attorney, Agent, or Firm*—Michael J. Striker

[57] ABSTRACT

A stackable box of the type positionable in a stack with other boxes comprises a frame with walls formed of non-flowable moldable material having angular portions assembled to form outwardly extending corners. The frame is formed with a downwardly and inwardly extending lower portion and an upper portion. A horizontal base is located within the interior of the frame above the lower portion thereof. At least two walls of the frame are formed with a groove to receive a cover closing the box. An upwardly projecting web is formed at the upper portion of each wall adapted to extend toward the lower portion of the frame of the successive above-positioned box to form a locking connection therewith. The depth of the groove is sufficient to receive the cover as the latter is inserted into the frame in either flat or sloped position.

6 Claims, 3 Drawing Figures

STACKABLE BOX WITH ADJUSTABLE COVER

BACKGROUND OF THE INVENTION

The present invention relates to boxes especially stackable boxes utilized for packing and shipping certain products such as fruits, vegetables or the like.

The known box of the foregoing type used for packing fruits or vegetables includes a frame of a rectangular or square shape having walls formed of non-flowable moldable material and a base inserted into the frame and located above a lower edge thereof. The walls of the frame at their adjacent edges form outwardly extended corners. Such boxes may be used one time and disposed thereafter or may be utilized repeatedly for packing and shipping fruits, vegetables, or ' the like. Boxes which are to be used only once are usually destroyed at the point of distination.

It should be taken into consideration that the boxes should be so constructed that the costs of packaging and storing of the goods would be minimal and once used boxes should be easily destroyed without remainders; for example, burned so that they would not be detrimental for the environment.

It is also important that the boxes for packing perishable products such as fruits and vegetables must have sufficient rigidity to protect the goods to be shipped. The boxes for packing the forementioned products must be so constructed that they will not eventually be disintegrated by the influence of moisture absorbed by the material of the walls of the box, either from the products which they contain or from the environment.

Packing and shipping of certain types of fruits and vegetables require that boxes in which they are shipped be covered to protect the products to be packed. During the shipment of such perishable products, some of the products, such as grapes, may require use of an intermediate packing material which may be inserted between individual layers of the products. These products when initially packed may not be settled down so that the uppermost surface of the products may initially be located higher than the upper box edge.

SUMMARY OF THE INVENTION

It is therefore an object of the invention to provide an improved stackable box.

Another object of the invention is to provide a relatively inexpensive stackable box.

The stackable box of the invention does not require additional connecting elements between the boxes assembled in a stack such as nails, clips, or the like. The covers closing the boxes in a stack may be easily released if required for a purpose of control of the goods to be packed.

These and other objects of the invention are attained by a stackable box which includes a frame of a substantially rectangular shape with four adjacent walls formed of non-flowable moldable material and assembled to form outwardly extending corners at the adjacent edges thereof, and having a lower portion and a horizontal base located above the lower edge of the frame. At least two walls are formed with a groove provided at an upper edge of each of the walls to receive a cover for closing an upper end of the box.

Since a cover of the box according to the invention be insertable into the frame in either seat or sloped position a depth of the groove is chosen to be sufficient to engage the cover irrespective of whether the latter is either in such a flat or in a sloped position.

The walls of the frame may all be of the same size or they may be of different sizes.

The groove may be provided with an upwardly extended web projecting to engage the lower portion of the frame of a successive upwardly positioned box to form a locking connection therewith.

The groove includes a lower curved portion which extends in a horizontal direction so that it ends a predetermined distance from the corners formed in the frame of the box.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
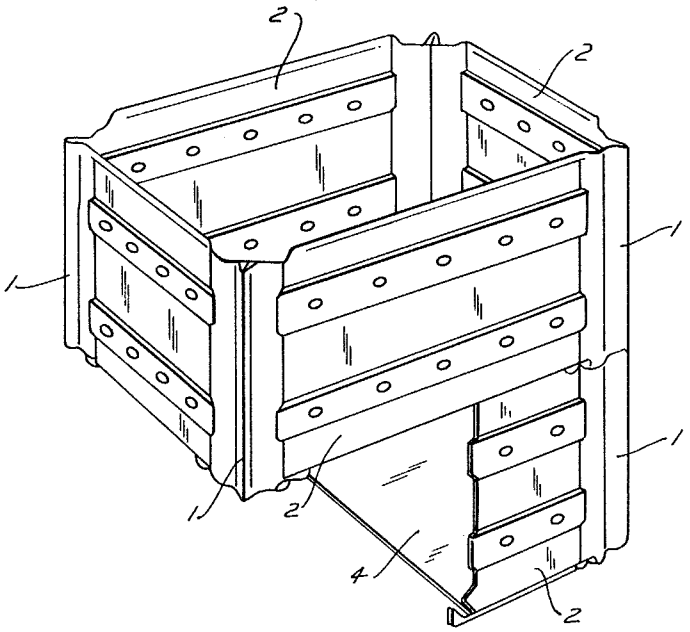
FIG. 1 shows a perspective view of two stackable boxes, one on top of the other, with a portion of the bottom box removed in accordance with the invention.
Figure 3:
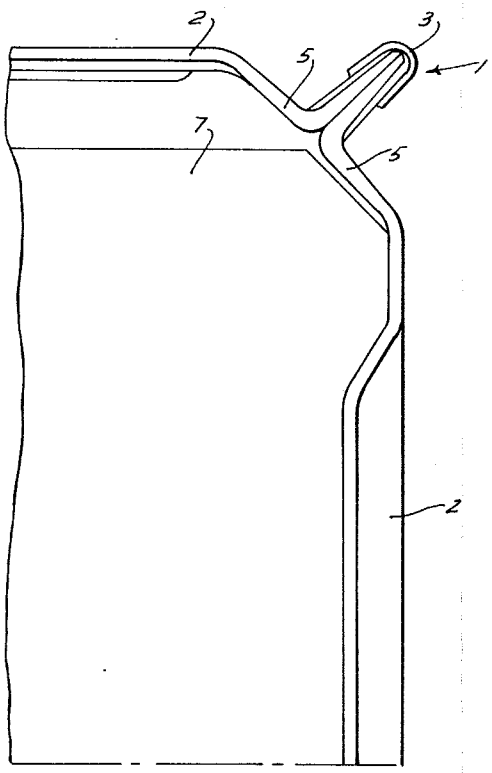
FIG. 3 is a partial plan view of the box according to the invention.
Figure 2:
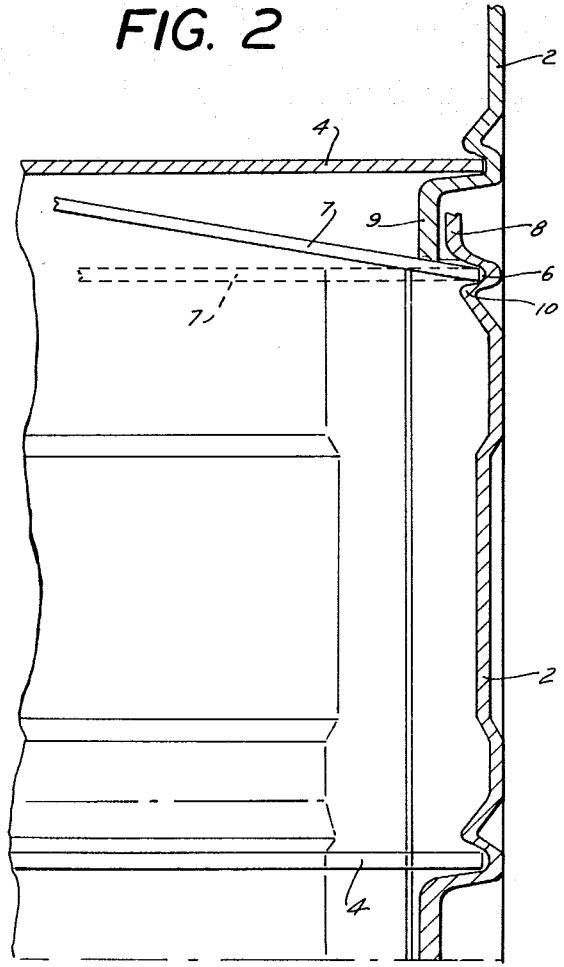
FIG. 2 illustrates an elevational sectional view of the stackable box of the invention.

Referring now to FIGS. 1–3, an improved stackable box of the invention includes a generally rectangular or square frame 2 including walls, the adjacent ends of which form outwardly extended corners 1. The walls in their corners may be connected to each other by means of wires, clips, joints of synthetic material designated at 3 in FIG. 3 or any other fastening means. A base or bottom wall 4 is inserted into the frame 2 to be placed onto the inwardly extending projections of the frame 2 formed by the lower edges 9 shown in FIG. 2. Each wall of the frame 2 is provided with an angular portion 5 each of which merges into an outwardly extending projection; the projections of adjacent walls when connected are fixed to each other and embraced by joints 3. The upper edge of the frame 2 is formed with a groove 6 which engages the side edges of a cover 7 when the latter is placed onto the frame to close the same. It should be noted that the depth of the groove is sufficient to engage the cover 7 when the latter is placed into the frame either in its flat (shown by dotted lines) or its sloped positions (shown by solid lines). The groove 6 has an elongated web 8 upwardly extending therefrom toward the lower edge 9 of the frame 2 of the successive box positioned above the lower box in the stack. The webs 8 of the frame walls engage the lower edge 9 of the upper box thereby providing a form-locking connection there-between so as to prevent movement and maintain the upper box in the stack against displacement generally in a horizontal plane with respect to the lower box. The distance between the cover 7 of one box in a stack and the base of the successive super imposed box may be varied dependent upon the height of the webs 8 and the lower edges 9 of the successive upper box.

The upper edge of the frame 2 having the groove 6 merging into the web 8 and including a lower curved portion 10, is so formed that the groove 6, the web 8, and the curved portion 10, in combination extend in a horizontal direction along the width of the wall of the frame in such a manner that they end a predetermined distance from the corner 1. This construction improves the rigidity and stability of the structural elements of the box.

It will be understood that each of the elements described above, or two or more together, may also find a useful application in other types of stackable chest arrangement differing from the types described above.

While the invention has been illustrated and described as embodied in a stackable chest arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A box, particularly a stackable box, comprising a frame of a substantially right-angled shape with four adjacent walls of non-flowable moldable material and each having an outwardly extending angular portion, the angular portions of adjacent walls being secured to each other, and forming outwardly extending corners of the box, said frame having a lower inwardly and downwardly extending portion and an upper portion; a cover, which may be inserted into said frame in either a substantially horizontal position or in a position inclined to the horizontal; and a horizontal base inserted into said frame at a lower edge thereof and located above said lower portion, at least two of said walls being formed with a groove provided at an upper portion of each of the two walls to receive said cover for closing an upper end of said box, said groove each having a depth which is suficient to engage said cover when the latter is in either of said positions, said upper portion having a web upwardly extending from said groove, said web being adapted to engage the lower portion of the frame of a successive upwardly positioned box in a stack to form a locking connection therewith.

2. The box of claim 1, wherein said frame has a rectangular shape.

3. The box of claim 1, wherein said frame has a square shape.

4. The box of claim 1, wherein said walls are all of the same size.

5. The box of claim 1, wherein different ones of said walls are of different sizes.

6. The box of claim 5, wherein said groove has a lower curved projection which ends a predetermined distance from said corners of said frame.

* * * * *